United States Patent [19]

Brown

[11] Patent Number: 4,612,713

[45] Date of Patent: Sep. 23, 1986

[54] ORTHOTIC FOR ATHLETIC USE

[76] Inventor: Dennis N. Brown, 8528 Custer School Rd., Custer, Wash. 98240

[21] Appl. No.: 719,347

[22] Filed: Apr. 3, 1985

[51] Int. Cl.[4] ..... A43B 13/38

[52] U.S. Cl. ..... 36/44; 36/76 C; 36/80; 12/146 M; 12/146 S; 128/614; 428/408

[58] Field of Search ..... 36/44, 43, 76 C, 22 A, 36/80; 12/146 M, 146 S, 146 R, 142 N; 428/408; 128/581, 586, 595, 614, 615

[56] References Cited

U.S. PATENT DOCUMENTS

| | | | |
|---|---|---|---|
| 2,644,250 | 7/1953 | Ciaio | 36/76 C |
| 2,713,968 | 9/1939 | King . | |
| 4,023,801 | 5/1977 | Van Auken | 428/408 X |
| 4,186,499 | 2/1980 | Massok, Jr. et al. | 36/44 |
| 4,231,169 | 11/1980 | Toyama et al. | 36/44 X |
| 4,338,734 | 7/1982 | Schwartz | 36/44 |
| 4,368,234 | 1/1983 | Palmer et al. | 428/408 X |
| 4,439,934 | 4/1984 | Brown | 36/44 |
| 4,520,581 | 6/1985 | Irwin et al. | 36/44 |

FOREIGN PATENT DOCUMENTS

| | | |
|---|---|---|
| 1489605 | 10/1977 | United Kingdom . |
| 1521682 | 8/1978 | United Kingdom . |

OTHER PUBLICATIONS

*The Runner,* Nov. 1982, Paying Through the Feet, by Hal Higdon, pp. 86–90.

*Primary Examiner*—James Kee Chi

[57] ABSTRACT

A rigid orthotic insert made of layers bonded to one another, with each of the layers being made of graphite fibers positioned parallel to one another. At least one of the inserts is made of several sections, with some of the sections having the fibers oriented at different angles, thus causing a desired pattern of transmission of forces through the insert.

10 Claims, 17 Drawing Figures

ORTHOTIC FOR ATHLETIC USE

CROSS REFERENCE TO RELATED APPLICATIONS

The subject matter of the present invention is related to the subject matter of five related patent applications being filed concurrently by the same applicant as in the present application, these five related applications being entitled: "Reinforced Heel Orthotic Insert", Ser. No. 719,324; "Improved Orthotic Insert", Ser. No. 719,341; "Orthotic Insert for High Heeled Shoes", Ser. No. 719,348; "Reinforced Orthotic Insert", Ser. No. 719,413; and "Improved Orthotic for Running", Ser. No. 719,479.

The subject matter of these five related applications is hereby incorporated by reference to the same.

BACKGROUND OF THE INVENTION

1. Field of the Invention

The present invention relates to an orthotic insert, and more particularly for such an insert which is particularly adapted to function effectively not only in a normal gait cycle experienced in walking and forward running, but also to function effectively for strenuous athletic activities, such as high jumping or basketball, where there is very high impact loading on the foot, as well as lateral motion which would cause high lateral force loads to be exerted against the foot (e.g. in basketball).

2. BACKGROUND ART

An orthotic insert can be either soft or hard. A hard insert is a substantially rigid member, desirably having a relatively thin vertical thickness dimension and extending from the calcaneus area of the foot (the heel portion) to at least the metatarsal head area of the foot (i.e. that area at the "ball" of the foot). In general, the purpose of a rigid orthotic (sometimes called a functional orthotic) is to first position, and then to control the movements of, the midtarsal and subtalar joints during the gait cycle which the body goes through in walking and running, and also possibly for other movements.

It is believed that a clearer understanding of the background of the present invention will be achieved by first discussing generally: (a) the main components or parts of the human leg and foot and how these function relative to one another; (b) the gait cycle which a person goes through in a normal walking motion; (c) stresses placed on the foot during running, jumping and lateral movements; and (d) the intended function of a rigid orthotic in optimizing the coordinated operation of the person's foot and leg throughout the gait cycle.

For convenience, these various topics will be discussed under appropriate subheadings.

(a) The Main Components or Parts of the Human Leg and Foot and How These Function Relative to One Another With reference to FIGS. 1–3, there is shown a typical human foot 10, and (in FIGS. 2 and 3) the lower part 12 of the leg 14. The two lower bones of the leg 14 are the tibia 16 and the fibula 18. Below the tibia 16 and fibula 18, there is the talus 20 (i.e. the "ankle bone"). Positioned below and rearwardly of the talus 20 is the calcaneus 22 (i.e. the heel bone). Positioned moderately below and forward of the talus 20 are the navicular 24 and the cuboid 26. Extending forwardly from the navicular 24 are the three cuneform bones 28. Extending forwardly from the cuneform bones 28 and from the cuboid 26 are the five metatarsals 30. Forwardly of the metatarsals 30 are the phalanges 32 which make up the five toes 34.

The movement of the talus 20 relative to the tibia 16 and fibula 18 is such that it enables the entire foot to be articulated upwardly and downwardly (in the motion of raising or lowering the forward part of the foot) and also to permit the entire foot 10 to be moved from side to side. However, the talus 20 is connected to the tibia 16 and fibula 18 in such a way that when the entire leg 14 rotated about its vertical axis (i.e. the axis extending the length of the leg), the talus 20 rotates with the leg 14.

With regard to the relationship of the talus 20 to the calcaneus 22, these move relative to one another about what is called the "subtalar joint" indicated at 36. The subtalar joint 36 can be described generally as a hinge joint about which the talus 20 and calcaneus 22 articulate relative to one another. The hinge axis extends upwardly and forwardly at an angle of about 42° from the horizontal, and also slants forwardly and inwardly at a moderate angle (e.g. about 16° from a straightforward direction).

To explain further the hinge motion of the subtalar joint 36, reference is now made to FIGS. **4*a* and 4*b*. The talus 20 can be considered as a vertical board 40, and the calcaneus 22 as a horizontally extending board 42, these being hinge connected to one another along a diagonal hinge line 44, with this hinge line corresponding to the subtalar joint 36. It can be seen with reference to FIG. 4*a* that as the talus 20 is rotated inwardly about its vertical axis (i.e. the front part of the leg being rotated toward the center of the person's body), there is a corresponding rotation of the calcaneus 22 (i.e. the horizontal board 42) about a horizontal axis. It can be seen in FIG. 4*b* that an opposite (i.e. outward) rotation of the talus 20 (i.e the vertical board 40) causes a corresponding rotation of the calcaneus 22 (i.e. the horizontal board 42) in the opposite direction to that shown in FIG. 4*a***.

This motion described with reference to FIGS. **4*a* and 4*b*** above is critical in the gait cycle (i.e. the cycle through which the person goes in normal walking or running motion), and this will be discussed more fully below.

With regard to the midtarsal joint 38, this is in reality composed of two separate joints, the talo-navicular and the calcaneal-cuboid. It is a complex joint, and no attempt will be made to illustrate or recreate its motion accurately. Instead, there will be presented a somewhat simplified explanation of its function as it relates to the present invention.

The main concern, relative to the midtarsal joint, is not the precise relative motion of the parts of the foot that make up this joint, but rather the locking and unlocking mechanism of the midtarsal joint which occurs when there is an outward motion of the leg 14 and the talus 20 (outward motion meaning the rotation of the leg 14 and foot 10 about the vertical axis of the leg 14 in a manner that the knee moves outwardly from the person's body), and an opposite inward motion, respectively. When the leg 14 rotates inwardly, the midtarsal joint 38 unlocks so that the portion of the foot 10 forwardly of the joint 38 (i.e. the midfoot 45) is flexible, this being the "pronated" position of the foot. On the other hand, when the leg 14 and talus 20 rotate outwardly, the foot is said to be "supinated" so that the midtarsal joint 38 is locked and the midfoot 45 essentially becomes a part of a rigid lever. In actuality, the midfoot 45 never becomes totally rigid, so that even in the totally supinated position, there is some degree of flexibility in the midfoot 45.

This function of the midtarsal joint will now be explained relative to FIGS. 5*a* and 5*b*. It can be seen that FIGS. 5*a–b* are generally the same as FIGS. 4*a–b*, except that a forward board member 46 is shown to represent the midfoot 45, this member 46 having a downward taper in a forward direction, and also a lower horizontal plate portion 48. This plate portion 48 is intended to represent that the plantar surface (i.e. the lower support surface) of the midfoot 45 engages the underlying support surface in a manner so as to remain generally horizontal to the support surface.

It can be seen that when the two board members 40 and 42 are in the pronated position of FIG. 5*a*, the metatarsal joint represented at 50 in FIGS. 5*a–b* is in a first position which will be presumed to be an unlocked position. In the unlocked position of FIG. 5*a*, the member 46 is not rigid with the horizontal member 42, and the forward member 46 can flex upwardly relative to the horizontal member 42. (This is the pronated position of the foot 10.) However, in the position of FIG. 5*b*, the board members 46 and 42 will be presumed to be locked to one another so that the members 42 and 46 form a unitary lever. For ease of illustration, no attempt has been made to illustrate physically the unlocking relationship of FIG. 5*a* and the locking relationship of FIG. 5*b*. Rather, the illustrations of FIGS. 5*a–b* are to show the relative movement of these components, and the locking and unlocking mechanism is presumed to exist.

(b) The Gate Cycle Which the Person Goes Through in a Normal Walking Motion

Reference is first made to FIGS. 6*a* and 6*b*. As illustrated in the graph of FIG. 6*a*, during the normal walking motion, the hip (i.e. the pelvis) moves on a transverse plane, and this movement in the gait cycle is illustrate in FIG. 6*b*. Also, the femur (i.e. the leg bone between the knee joint and the hip) and the tibia rotate about an axis parallel to the length of the person's leg. (It is this rotation of the leg about its vertical axis which in large part causes the pronating and supinating of the foot during the gait cycle, and this will be explained in more detail below.)

There is also the flexing and extension of the knee, as illustrated in the five figures immediately below the graph of FIG. 6*a*. Further, there is the flexing and extension of the ankle joint. At the beginning of the gait cycle, the heel of the forwardly positioned leg strikes the ground, after which the forward part of the foot rotates downwardly into ground engagement. After the leg continues through its walking motion to extend rearwardly during the gait cycle, the person pushes off from the ball of the foot as the other leg comes into ground engagement.

The motions described above are in large part generally apparent to a relatively casual observation of a person walking. However, the motion which is generally overlooked by those not familiar with the gait cycle is the inward and outward rotation of the leg about its lengthwise axis to cause the pronating and supinating of the foot through the gait cycle. This will be described relative to FIG. 7*a* and FIG. 7*b*.

When the leg is swung forwardly and makes initial ground contact, at the moment of ground contact the leg is rotated moderately to the outside (i.e. the knee of the leg is at a more outward position away from the centerline of the body) so that the foot is more toward the supinated position (i.e. closer to the position shown in FIG. 4*b*). However, as the person moves further through the gait cycle toward the 25% position shown in FIG. 7*a*, the leg rotates about its vertical axis in an inside direction so that the subtalar joint is pronating. The effect of this is to rotate the heel of the foot so that the point of pressure or contact moves from an outside rear heel location (shown at 52 in FIG. 7*b*) toward a location indicated at 54 in FIG. 7*b*. This pronating of the subtalar joint 36 produces a degree of relaxation of the midtarsal joint 38 and subsequent relaxation of the other stabilization mechanisms within the arch of the foot. This reduces the potential shock that would otherwise be imparted to the foot by the forward part of the foot making ground contact.

With further movement from the 25% to the 75% position, the leg rotates in an opposite direction (i.e. to the outside) so that the midtarsal joint 38 becomes supinated at the 75% location of FIG. 7*a*. This locks the midtarsal joint 38 so that the person is then able to operate his or her foot as a rigid lever so as to raise up onto the ball of the foot and push off as the other leg moves into ground contact at a more forward location.

With reference again to FIG. 7*b*, the initial pressure at ground contact is at 52 and moves laterally across the heel to the location at 54. Thereafter, the pressure center moves rather quickly along the broken line indicated at 56 toward the ball of the foot. As the person pushes off from the ball of the foot and then to some extent from the toes of the foot, the center of pressure moves to the location at 58.

(c) Stresses Placed on the Foot During Running, Jumping and Lateral Movements When a person is going through the running motion, the gait cycle is accelerated, and also there is a period where the person's feet are both off the ground. When there is a heel strike during the running, there is generally a higher instantaneous force load exerted against the heel of the foot than there is in walking. However, for some runners, there is no initial heel strike. Rather, the initial force or ground contact is at an outside middle portion of the foot, with the center of pressure moving inwardly toward the centerline of the foot and then forwardly as there is push off.

For a jumping motion, the foot will generally be in the supinated position, so that the midtarsal joint is locked, thus enabling the person to jump off the ball of the foot. Depending upon the force of the jumping motion, it can be expected that the force loads on the foot would substantially exceed those experienced during normal running.

With regard to the side to side motion, it can be appreciated that depending upon the direction of movement relative to the foot, there will be a force pattern exerted on the foot that moves from one side of the foot to the other.

(d) The Intended Function of the Orthotic to Improve Operation of the Person's Foot and Leg Throughout the Gate Cycle If the person's foot were perfectly formed, then there would be no need for an orthotic device. However, the feet of most people deviate from the ideal. Accordingly, the function of the orthotic is first to position the plantar surface of the calcaneus 22 and the midfoot 45 so that the subtalar and midtarsal joints 36 and 38 are initially positioned properly, and to thus control the subsequent motion of the foot parts or components that make up these joints so that the movements of the hip, leg and foot throughout the gait cycle are properly accomplished. It can be readily understood that if the components of the foot have the proper initial position and movement about the subtalar and midtarsal joints 36 and 38, the entire gait cycle, all the way from the coordinated rotation of the hips through the flexing and rotation of the leg, and also through the initial strike of the heel on the ground to the final push off from the toe of the foot, is properly coordinated and balanced for optimum movement.

Since shoes are generally manufactured on a mass production basis, the supporting surface of the interior of the shoe may or may not optimally locate the plantar surface of the foot. Accordingly, it has for many years been a practice to provide an orthotic insert which fits within the shoe to optimize the locations of the foot components. In general, these inserts have been made of various materials, some of which are formed as laminated structures to provide a relatively rigid support for the heel and midfoot regions of the foot.

These orthotics can be formed in a variety of ways. A preferred method of forming an orthotic insert is described in the applicant's U.S. Pat. No. 3,995,002. In that method, there is formed a negative mold or slipper cast from which a positive cast of the plantar surface of the individual's foot is formed. Using this positive cast as a template, an orthotic insert is formed to underlie an area under the foot. The insert itself is fabricated by applying to the positive cast the material which is to orthotic insert. The precise configuration of the insert will depend upon the prescribed corrective measures to be taken for the individual's foot.

SUMMARY OF THE INVENTION

The present invention embodies the broad teachings of U.S. Pat. No. 4,439,934, and provides specific improvements for the same.

There is a substantially unitary orthotic insert adapted to be placed in an article of footwear. The insert has a longitudinal axis parallel to a lengthwise axis of a foot for which the insert is used, and a transverse axis. The insert comprises a rear portion adapted to underlie and engage a plantar surface of a calcaneal area of the foot. There is a forward portion adapted to underlie and engage a plantar surface of a metatarsal head area of the foot. There is an intermediate portion connecting to and extending between the rear and forward portions to engage a plantar surface of a midfoot area of the foot. The insert has outside and inside edge portions adapted to be positioned adjacent an outside edge and an inside edge of the foot, respectively.

The insert has a laminated structure comprising a plurality of vertically stacked layers bonded to one another to form a substantially unitary structure. The laminated structure comprises a first laminate means comprising a plurality of generally parallel fibers having a substantial component of alignment parallel to the longitudinal axis. There is second laminate means comprising at least two sections, each of which is made up of a plurality of fibers generally parallel to one another. One of the sections is positioned forwardly of the other of the sections. The fibers of the one section have an orientation of alignment angled relative to an orientation of alignment of the other section.

Desirably, the second laminate means comprises a second layer made up of two sections. Each of the two sections of the second layer has parallel fibers, with the fibers of one of the sections of the second layer being angled relative to the fibers of the other section of the second layer. The fibers of the second layer are angled to the fibers of the first layer which have corresponding locations in the insert.

In the preferred form, the fibers comprise graphite fibers.

Also, in the preferred form, the second laminate means comprises a rear section, a middle section, and a forward section. The alignment of the rear section and the forward section is such that the fibers of these two sections are angled from the longitudinal axis in a first direction. The alignment of the fibers of the middle section has an orientation of alignment angled from the longitudinal axis in a direction opposite to the orientation of the fibers of the rear section and the forward section.

Also, in the preferred embodiment, the second layer has a rear section, a middle section and a forward section. These are in vertical alignment with corresponding sections of the first layer.

Other specific features of the present invention will become apparent from the following detailed description.

DESCRIPTION OF THE PREFERRED EMBODIMENTS

The present invention comprises a more specific improvement of the orthotic insert described in the applicant's issued U.S. Pat. No. 4,439,934.

As described in that patent, the overall method for forming the insert is generally the same as that described in applicant's U.S. Pat. No. 3,995,002. There is first provided a negative mold, from which a positive cast (i.e. a cast resembling the structure of a person's foot) is formed. Using this positive cast as a template, an orthotic insert is formed to underlie the area of the foot from the calcaneal area forward to the first metatarsal head, including the arch area, and from there laterally to the distal side of the foot or fifth metatarsal head. The insert itself is fabricated by applying to the positive cast layers of fiber impregnated with resin. The assembled layers are then heat cured and cut to the limits of the cast.

As further discussed in the applicant's U.S. Pat. No. 4,439,934, the flexing characteristics of the insert, which are integral to its performance, can be beneficially controlled by adjusting the placement, amount and direction of graphite fibers, and in some instances, other fibers such as glass fibers. The insert so formed is extremely light weight and relatively thin in comparison to conventional orthotic inserts.

Figure 1:
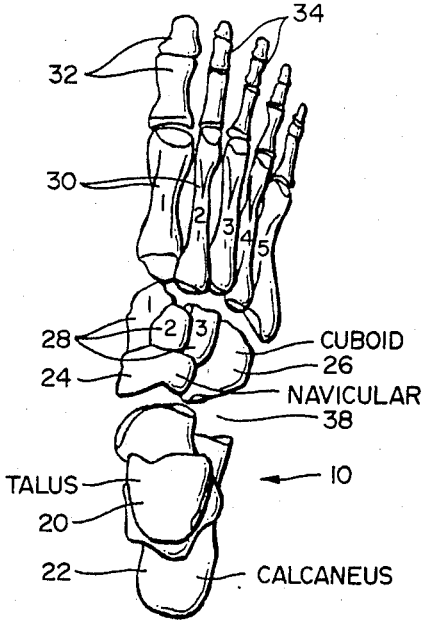
FIG. 1 is a top plan view of the right foot of a human, with certain components of the foot being separated from one another for purposes of illustration.
Figure 2:
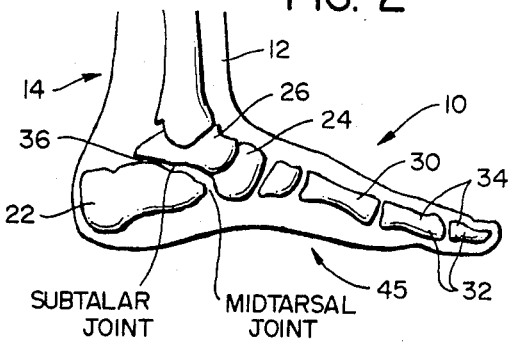
FIG. 2 is a side elevational view looking toward the inside of a person's left foot, with the outline of the foot and lower leg being shown as a shaded area.
Figure 3:
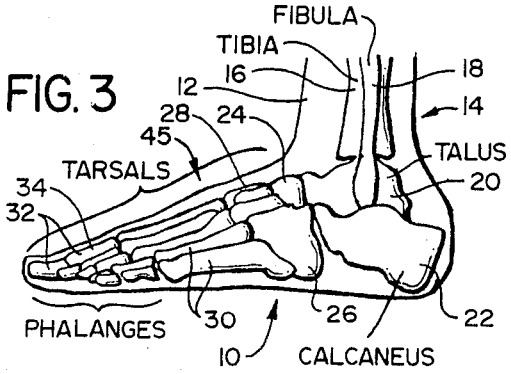
FIG. 3 is a view similar to FIG. 2, but looking toward the outside of the person's foot.
Figure 4A:
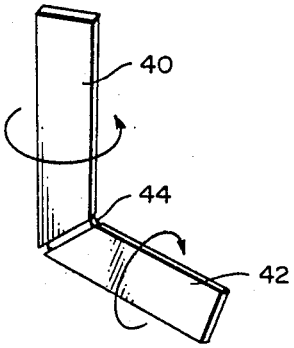
FIGS. 4*a* and 4*b* are perspective views illustrating schematically the rotational movements of the talus and calcaneus about the subtalar joint.
Figure 4B:
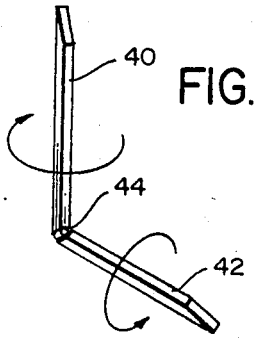
Figure 5A:
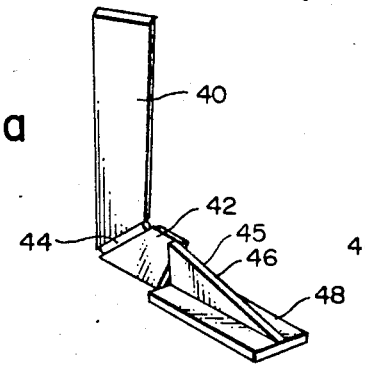
FIGS. 5*a* and 5*b* are schematic views similar to those of FIGS. 4*a–b,* but further illustrating the relative movement between the calcaneus and the midfoot about the midtarsal joint.
Figure 5B:
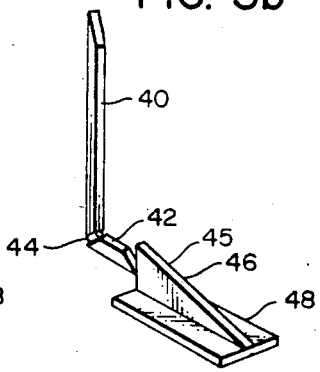
Figure 6A:
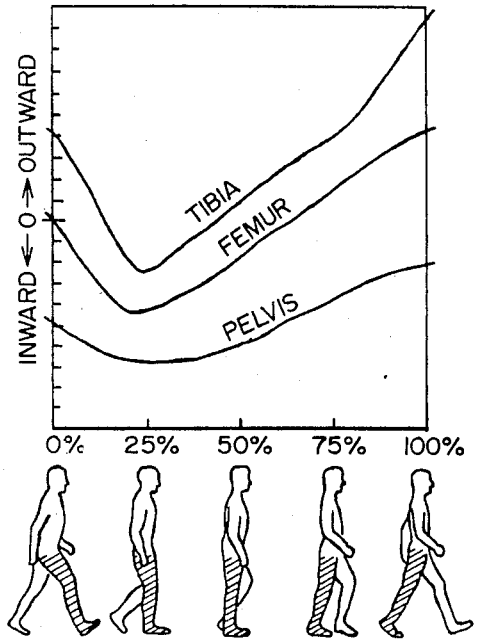
FIG. 6*a* is a graph illustrating the rotational movement of the pelvis, femur and tibia during one-half of a gait cycle.
Figure 6B:
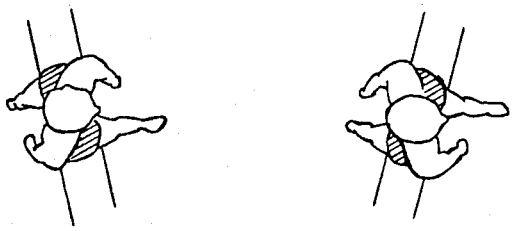
FIG. 6*b* is a top plan view illustrating the rotation of the person's pelvis during that portion of the gait cycle illustrated in FIG. 7*a;*
Figure 7A:
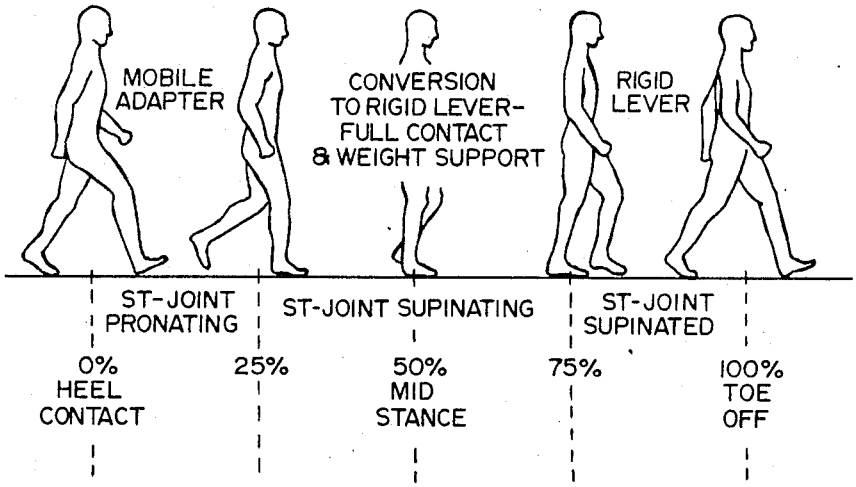
FIG. 7*a* is a graph similar to FIG. 6*a,* but illustrating the timing of the pronating and supinating motion of the leg and foot through one-half of a gait cycle.
Figure 8:
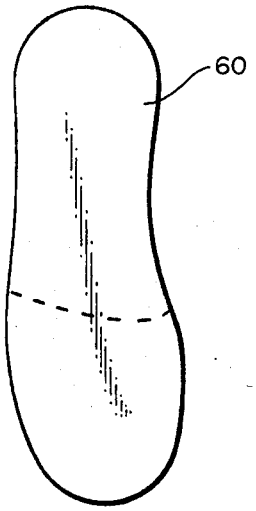
FIG. 8 is a top plan view of an upper soft portion of an orthotic device, made to fit a person's right foot.

To proceed to a more detailed description of the present invention, in FIG. 8, there is shown a two layered first blank 60 which is generally configured to the outline of a bottom of an individual's foot. This blank 60 can be of conventional configuration. For example, it can include an upper layer of a cloth material such as nylon, Dacron, cotton or the like which is abrasion resistant and absorbs perspiration well. It can further comprise a second layer of flexible rubber or neoprene or the like which is co-extensive with and adheres to the upper layer. While this first blank 60 is desirably used in the present invention, within the broader aspects of the present invention, this blank 60 is not an absolutely necessary element.

Figure 9:
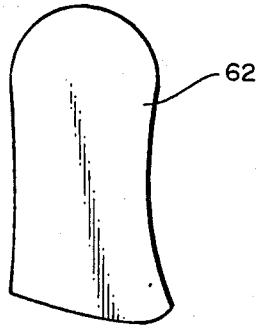
FIG. 9 is a top plan view of another portion of the orthotic insert toward which the subject matter of the present invention is particularly directed.
Figure 10:
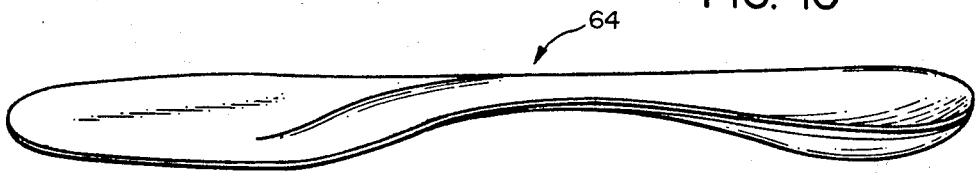
FIG. 10 is an isometric view of an insert made in accordance with the present invention.
Figure 7B:
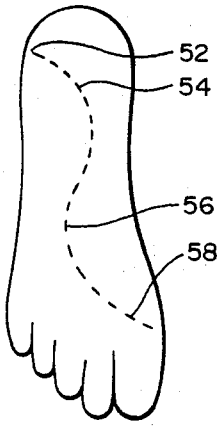
FIG. 7*b* is a view looking upwardly toward the plantar surface of a person's left foot, and illustrating the distribution or location of the center of pressure throughout the period of ground contact of the portion of the gait cycle illustrated in FIGS. 6*a* and 7*a;*

In FIG. 9, there is a second blank 62 which incorporates the teachings of the present invention. In the end configuration of the present invention, this blank 62 underlies the blank 60 and is bonded thereto. The end configuration of the two blanks 60 and 62 is illustrated in FIG. 10, which is a perspective view of the end product.

In the applicant's earlier U.S. Pat. No. 4,439,934, the method of forming the blank 62 was described generally. This blank 62 can be formed and contoured around a positive cast obtained using the method and apparatus disclosed in applicant's U.S. Pat. No. 3,995,002. Then various arrangements of layers of fiberglass or graphite, impregnated with resin, are laid upon the positive cast to form the second blank 62.

With respect to the novel features of the present invention, it has been found that within the broad teaching of U.S. Pat. No. 4,439,934, the orientation of certain of the fibers in the layer or layers can be selected in certain configuration to improve the performance characteristics of the orthotic insert in specific ways.

Figure 11:
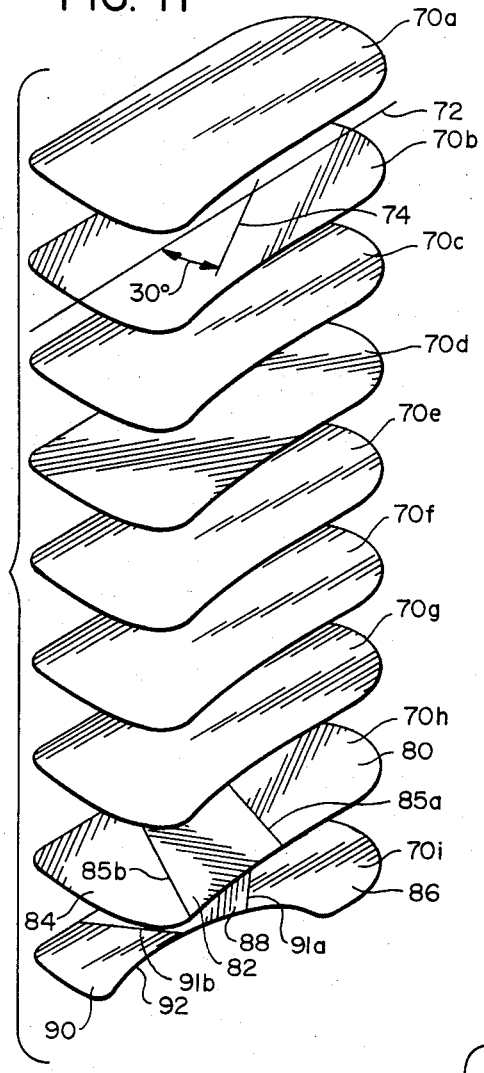
FIG. 11 is a perspective view of nine layers that are used to make up an insert section for the present invention.

With reference to FIG. 11, it can be seen that the insert section or blank 62 is made up of nine layers, designated 70*a–i*. The top eight layers 70*a–h*, in plan view, have the same configuration as that of the insert section 62. All of these layers are made from sheet material of parallel graphite fibers impregnated with resin.

Five of the layers (i.e. 70*a, c* and *e–g*) have the graphite fibers oriented parallel to the lengthwise or longitudinal axis 72 of the insert. The second layer 70*b* has its graphite fibers oriented along a diagonal line extending from a rear outside location to a forward inside location. As shown herein, the graphite strands are desirably oriented at 30° off the longitudinal axis 72. In the preferred form, however, this precise orientation can vary depending upon the particular function to be accomplished. In general, the orientation of these strands (indicated by the line 74) relative to the longitudinal axis 72 would be greater than 0° from the longitudinal axis 72, and generally no greater than about one-half of a right angle from the longitudinal axis 72.

The graphite fibers of the fourth layer 70*d* are generally the same as that of the second layer 70*b*, except that the angle of orientation is from a rear inside location to a forward outside location.

The eighth layer 70*h* is also made of graphite fibers impregnated with resin, but is formed in three sections. There is a first rear section 80, an intermediate section 82 and a forward section 84. These three sections 80, 82 and 84 are butted against one another and bonded to one another at lines 85*a* and 85*b*. The sections 80 and 84 have a fiber orientation extending from a rear outside location to a forward inside location, with the preferred angle of orientation being about 30° off the longitudinal axis. Within a broader range, the orientation would be greater than 0° from the longitudinal axis, but no greater than about 45° from the longitudinal axis.

The intermediate section 82 has the fibers oriented at approximately right angles to the orientation of the fibers of the sections 80 and 84. Thus, the orientation of the fibers in the layer 82 would be from an inside rear location to an outside forward location, making an angle of approximately 60° with the longitudinal axis.

The lowermost section 70*i* also is made of three sections, these being designated 86, 88 and 90. The rear section 86 and the forward section 90 both have the graphite fibers oriented parallel to the longitudinal axis. The intermediate section 88 has the fiber orientation extending along a line from a rear outside location to a forward inside location, with the angle of orientation being about 45° from the longitudinal axis, or possibly 50° or greater. These sections are joined together at lines 91*a* and 91*b*.

Further, the forward and middle side portions of the lowermost layer 70*i* are cut away as at 92.

It has been found that this particular configuration gives substantial strength and support not only for straightforward running, but also for other athletic maneuvers, such as jumping. Further, with the lateral orientation of some of the fibers in the two lowermost layers, there is added strength along the transverse axis, particularly with respect to the middle portion of the insert section.

Figure 12:
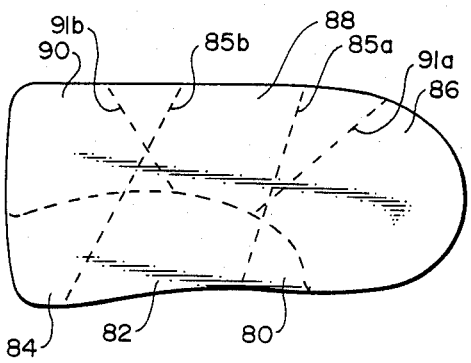
FIG. 12 is a top plan view illustrating the juncture lines of the bottom two layers illustrated in FIG. 11.
Figure 13:
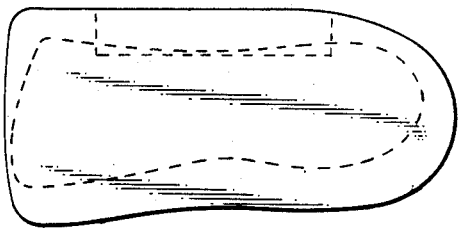
FIG. 13 is a top plan view showing the insert section resulting from the stack up of FIG. 12.

The location of the junctive lines are drawn in FIG. 12 at the appropriate locations and are properly indicated in FIG. 12 to an accurate scale. Thus, the representation of FIG. 12 is intended to be part of the disclosure of the present invention relative to the location of the lines 85*a–b* and 91*a–b*.

One of the advantages of the present invention is that the orientation of the graphite fibers can be arranged in such a manner that the energy which is imparted to one part of the insert by that portion of the foot pressing against that portion of the insert can be transferred along the insert, generally in the direction of the orientation of the fibers to another part of the insert. For example, let it be assumed that the rear portion of the person's foot first comes into ground engagement so that it causes a moderate deformation of the underlaying rear part of the insert. Then, as the person proceeds through the gait cycle so that the center of pressure moves to a more forward location of the foot, as the force at the rear portion of the foot is diminished, the rear portion of the insert that has been deflected will now tend to return quickly to its original position. As it does so, the resilient nature of the graphite structure actually tends to return this force back to the foot, thus in a sense aiding the foot through the remaining portion of the propulsive phase of the gait cycle. To explain this, in another sense, the insert captures, retains and directs the energy to the area of maximum performance.

These layers 70*a–i* are bonded and cured to form the unitary blank 62. More specifically, the layers can be conformed to the contour of the mold, preheated for a period of time, cured at 350° F. for about 45 minutes, and then be affixed to the bottom of the first blank 60 to create the final insert 64.

It is to be understood that within the broader scope of the embodiments shown herein, the angular variation of the fibers can be modified, depending upon the special requirements of the person's foot. Also, while the particular layup of these layers has been found to be quite advantageous, it is to be understood that certain additions or deletions could be made depending upon the particular circumstances relating to that person's foot. Also, the order or placement of the layers could be modified and still function within the general mode of operation of the present invention.

I claim:

1. A substantially unitary orthotic insert adapted to be placed in an article of footwear, said insert having a longitudinal axis parallel to a lengthwise axis of a foot for which the insert is used, and a transverse axis, said insert comprising:

a. a rear portion adapted to underlie and engage a plantar surface of a cacaneal area of the foot;

b. a forward portion adapted to underlie and engage a plantar surface of a metatarsal head area of the foot;

c. an intermediate portion connecting to and extending between said rear and forward portions to engage a plantar surface of a mid-foot area of the foot;

d. said insert having outside and inside edge portions adapted to be positioned adjacent an outside edge and an inside edge of the foot, respectively;

e. said insert having a laminated structure comprising a plurality of vertically stacked layers bonded to one another to form a substantially unitary structure, said laminated structure comprising:

1. a first laminate means comprising a plurality of generally parallel fibers having a substantial component of alignment parallel to said longitudinal axis; 2. a second laminate means comprising at least two sections, each of which is made up of a plurality of fibers generally parallel to one another, one of said sections being positioned forwardly of the other of said sections, the fibers of the one section having an orientation of alignment angled relative to an orientation of alignment of the other section.

2. The insert as recited in claim 1, wherein said second laminate means comprises a second layer made up of two sections, each of the two sections of the second layer having parallel fibers, with the fibers of one of the sections of the second layer being angled relative to the fibers of the other section of the second layer, the fibers of the second layer being angled to the fibers of the first layer which have corresponding locations in the insert.

3. The insert as recited in either of claims 1 or 2, wherein the fibers comprise graphite fibers.

4. A substantially unitary orthotic insert adapted to be placed in an article of footwear, said insert having a longitudinal axis parallel to a lengthwise axis of a foot for which the insert is used, and a transverse axis, said insert comprising:

a. a rear portion adapted to underlie and engage a plantar surface of a cacaneal area of the foot;

b. a forward portion adapted to underlie and engage a plantar surface of a metatarsal head area of the foot;

c. an intermediate portion connecting to and extending between said rear and forward portions to engage a plantar surface of a mid-foot area of the foot;

d. said insert having outside and inside edge portions adapted to be positioned adjacent an outside edge and an inside edge of the foot, respectively;

e. said insert having a laminated structure comprising a plurality of vertically stacked layers bonded to one another to form a substantially unitary structure, said laminated structure comprising:

1. first laminate means having a plurality of fibers positioned generally parallel to one another, with said fibers having a substantial alignment component parallel to the longitudinal axis;

2. a second laminate means comprising a first layer having a rear section, a middle section, and a forward section;

i. said rear section having a plurality of fibers generally parallel to one another and having an orientation of alignment angled relative to said longitudinal axis in a first direction to one side of said longitudinal axis;

ii. said middle section having a plurality of fibers generally parallel to one another and having an orientation of alignment angled from the longitudinal axis in a direction opposite to the orientation of alignment of the fibers of the rear section;

iii. said forward section having a plurality of fibers generally parallel to one another, with said fibers having an orientation of alignment angled from the longitudinal axis on the same side of the longitudinal axis as the first section.

5. The insert as recited in claim 4, wherein there is second layer in said second laminate means, said second layer having a rear section, a middle section, and a forward section, each of which is in vertical alignment with the rear, middle and forward sections of the first layer, the first, second and third sections of the second layer each being made of a plurality of generally parallel fibers, the fibers of the first, second and third sections of the second layer being angled relative to the fibers of the rear, middle and front sections, respectively, of the first layer.

6. The insert as recited in claim 5, wherein the rear and forward sections of the first layer are generally aligned with one another.

7. The insert as recited in claim 6, wherein the rear and front sections of the second layer have their fibers generally aligned with one another.

8. The insert as recited in claim 5, wherein the rear and front sections of the second layer have their fibers generally aligned with one another.

9. The insert as recited in claim 5, wherein one of said layers has an inside forward portion thereof cut away.

10. The insert as recited in any one of claims 4, 5, 6, 7, 8, or 9, wherein said fibers comprise graphite fibers.

* * * * *